US005936331A

United States Patent [19]

Moss

[11] Patent Number: 5,936,331

[45] Date of Patent: Aug. 10, 1999

[54] ELECTRODE ASSEMBLY STRUCTURE

[75] Inventor: Russell W. Moss, Richmond Heights, Ohio

[73] Assignee: Channel Products, Inc., Chesterland, Ohio

[21] Appl. No.: 08/753,755

[22] Filed: Nov. 27, 1996

[51] Int. Cl.[6] ..... H01T 13/36; H01T 13/56

[52] U.S. Cl. ..... 313/135; 313/136; 313/138; 313/145; 445/7; 123/169 CB

[58] Field of Search ..... 313/138, 136, 313/135, 141, 144, 145, 146, 51, 125; 445/7; 123/169 CB

[56] References Cited

U.S. PATENT DOCUMENTS

| | | | |
|---|---|---|---|
| 2,281,511 | 4/1942 | Parkin | 313/135 |
| 2,489,410 | 11/1949 | Hahn | 313/135 |
| 2,934,668 | 4/1960 | Dall | 313/135 |
| 3,076,113 | 1/1963 | Candelise | 313/135 |
| 4,433,266 | 2/1984 | Riehl | 313/135 |

*Primary Examiner*—Sandra L. O'Shea
*Assistant Examiner*—Michael Day
*Attorney, Agent, or Firm*—James A. Hudak

[57] ABSTRACT

An electrode assembly having a structure which minimizes stress cracks within its outer housing is disclosed. The outer housing is comprised of a ceramic tube having a bore therethrough which is coated with an epoxy material. An insulated electrical conductor with the wires contained therein in an exposed condition adjacent the end thereof is received in one end of the tube and is slidably advanced within the bore to the approximate midpoint of the tube. An electrode member is received in the opposite end of the tube and is slidably advanced within the bore so that its end contacts the exposed wires of the electrical conductor causing the ends of the wires to flare outwardly and grippingly engage the surface defining the bore in the tube. Subsequent heating of the electrode assembly causes the epoxy within the bore of the tube to bind the tube to the electrode member, the exposed wires and the insulated portion of the electrical conductor resulting in a solid, unitary construction for the electrode assembly.

8 Claims, 2 Drawing Sheets

ELECTRODE ASSEMBLY STRUCTURE

TECHNICAL FIELD

The present invention relates, in general, to a structure for an electrode assembly that can be utilized to ignite a gas-fired burner and, more particularly, to a simplified electrode structure wherein the electrode is mechanically and electrically connected to an insulated electrical conductor and wherein the connection is made by and within a ceramic tube.

BACKGROUND ART

Various types of electrode assemblies are used to ignite gas-fired burners. Such electrode assemblies typically include a longitudinally extending metallic rod (the electrode) which is electrically and mechanically connected to an insulated electrical conductor. In a typical prior art assembly, the electrical and mechanical connection between the insulated electrical conductor and the electrode is made by means of a ferrule which is received over the end of the electrode and the exposed wires adjacent the end of the insulated electrical conductor and then subsequently crimped. The resulting electrode and electrical conductor assembly is then received within a ceramic tube having a counterbore and is positioned therein so that the electrode protrudes from one end thereof, the insulated electrical conductor extends outwardly from the other end thereof, and the electrical and mechanical connection is positioned within the counterbore. The electrode is then coined adjacent the end of the ceramic tube to minimize lateral movement of the electrode and the electrical conductor within the tube. A mounting bracket may be received over the end of the ceramic tube adjacent the counterbore therein. It has been found that the resulting electrode structure permits some lateral movement of the electrode within the tube causing stress cracks within the tube resulting in the ultimate failure of the tube. Additionally, since the mounting bracket is typically received over the tube adjacent the counterbore therein, and thus, applies compressive forces to the annular thin shell of the tube, there is a tendency for the mounting bracket to cause stress cracks within the tube resulting in the ultimate failure of the tube and electrode assembly.

In view of the foregoing, it has become desirable to develop an electrode assembly which utilizes a minimum number of components and wherein a firm electrical and mechanical connection is made between the electrode and the insulated electrical conductor, and the electrode and insulated electrical conductor are held together by an adhesive material, or the like.

SUMMARY OF THE INVENTION

The present invention solves the problems associated with the prior art and other problems by providing an electrode assembly having a structure which utilizes a minimum number of components and wherein a firm electrical and mechanical connection is made between the electrode and the insulated electrical conductor, and is held together by means of an adhesive material, or the like. The electrode assembly of the present invention is comprised of a ceramic tube having a bore therethrough coated with epoxy, an electrode and an insulated electrical conductor. The electrode is generally circular in cross-section and terminates in a conically shaped tip. The insulation is removed adjacent the end of the insulated electrical conductor exposing the wires therein, and the exposed wires are received within one end of the ceramic tube and are slidably advanced through the bore to the approximate midpoint of the tube. The electrode is then received within the opposite end of the tube and is slidably advanced through the bore so that its conically shaped tip contacts the exposed wires causing the ends of the wires to flare outwardly and grippingly engage the surface defining the bore in the tube. The electrode assembly is then heated causing the epoxy within the bore of the ceramic tube to bond the tube to the electrode, the exposed wires and the insulated portion of the insulated electrical conductor resulting in a solid, unitary construction for the electrode assembly preventing lateral movement of the electrode therein, and thus minimizing the possibility of stress cracks in the ceramic tube.

DESCRIPTION OF THE PREFERRED EMBODIMENT

Figure 1:
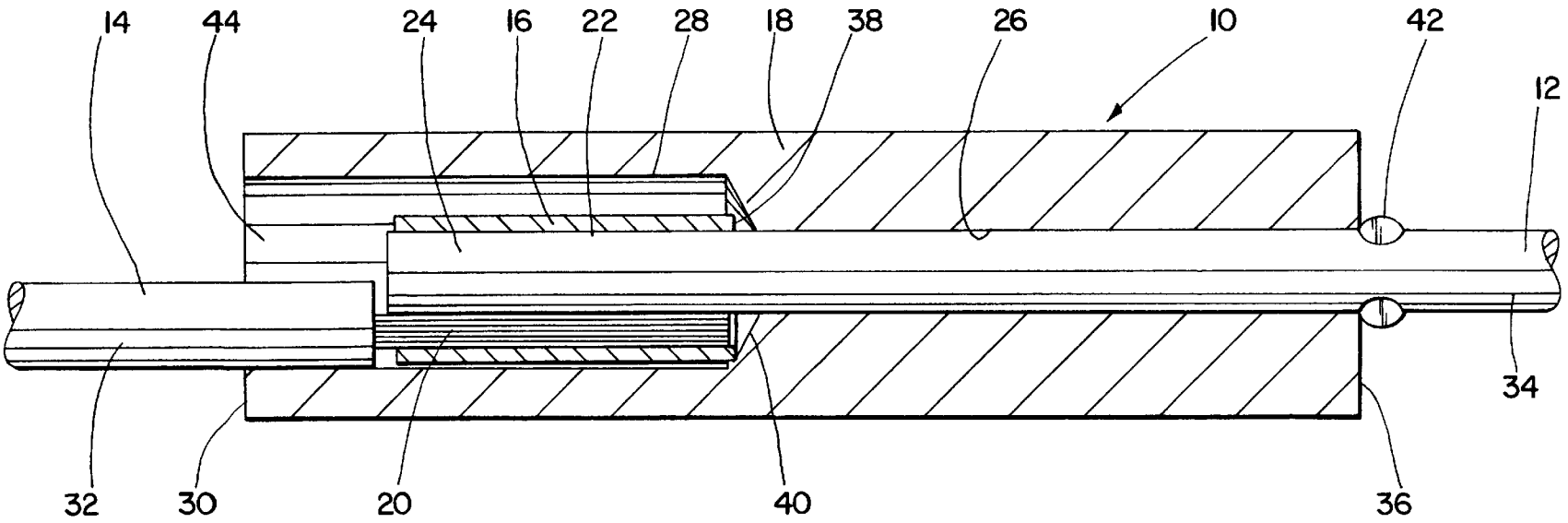
Fig. 1 (PRIOR ART)
FIG. 1 is a partial cross-sectional view of an electrode assembly of the prior art.

Referring now to the drawings where the illustrations are for the purpose of describing the preferred embodiment of the present of invention, and are not intended to limit the invention described herein. FIG. 1 is a partial cross-sectional view of an electrode assembly 10 of the prior art. Electrode assembly 10 is comprised of an electrode 12, an insulated wire 14, a ferrule 16 and a ceramic tube 18. To assemble the electrode assembly 10, the insulation is removed from the end of insulated wire 14 allowing the ends of the wires 20 therein to be exposed. The ends of wires 20 are then placed against the surface 22 defining the end 24 of electrode 12, which is generally circular in cross-section, and ferrule 16 is received over the end 24 of electrode 12 and the ends of wires 20. After the ferrule 16 is received over the end 24 of electrode 12 and the ends of wires 20, ferrule 16 is compressed or crimped causing the wires 20 to form a firm mechanical and electrical connection to the end 24 of electrode 12. A bore 26 is provided through tube 18, and a counterbore 28 is provided in the end 30 thereof. Bore 26 has a diameter slightly greater than the diameter of electrode 12. Counterbore 28 has a radius slightly greater than the combined thickness of the insulation on insulated wire 14, the cross-sectional thickness of the wires 20 within insulated wire 14 and the radius of the electrode 12 permitting the crimped connection of the electrode 12 and the wires 20, including the insulated portion 32 of the insulated wire 14, to be received within counterbore 28.

To assemble the electrode assembly 10 of the prior art, after the electrode 12 is mechanically and electrically connected to the ends of wires 20 contained within the insulated wire 14 by the ferrule 16, the electrode 12 is received through the bore 26 in ceramic tube 18 so that an end 34 of electrode 12 is positioned outwardly of the end 36 of tube 18 and a portion of the end 38 of ferrule 16 contacts the conically shaped bottom 40 of counterbore 28. After the electrode 12 has been received through the bore 26 in tube 18, the end 34 of electrode 12 is "coined" adjacent the end 36 of tube 18 resulting in the formation of oppositely disposed bumps or ears 42 on the periphery of electrode 12 minimizing any lateral movement of electrode 12 within tube 18. A potting material 44 is then received within counterbore 28 to encapsulate the insulated wire 14, the end 24 of electrode 12 and the ferrule 16 within the counterbore 28.

When utilized, it has been found that the electrode assembly 10 of the prior art has some inherent defects. For example, it has been found that the electrode 12 may be free to move somewhat laterally within the bore 26 of tube 18 since the location of the bumps or ears 42 on the end 34 of electrode 12 might not be precise enough to firmly contact the end 36 of tube 18. Alternatively, the end 38 of ferrule 16 might not firmly contact the conical bottom 40 of the counterbore 28 before the coining operation is performed producing the bumps or ears 42 on the end 34 of electrode 12. In any event, in some instances, the electrode 12 can move laterally or bend within the bore 26 of tube 18 causing the creation of stress cracks within tube 18 resulting in the ultimate failure of tube 18. In addition, a mounting bracket (not shown) is typically received over tube 18 and positioned adjacent the counterbore 28 therein. Since the mounting bracket is typically placed against the annular thin shell of tube 18 resulting from the counterbore 28 therein, there is tendency for the mounting bracket to cause the creation of stress cracks within tube 18 resulting in the ultimate failure of tube 18 and the electrode assembly 10.

Figure 2:
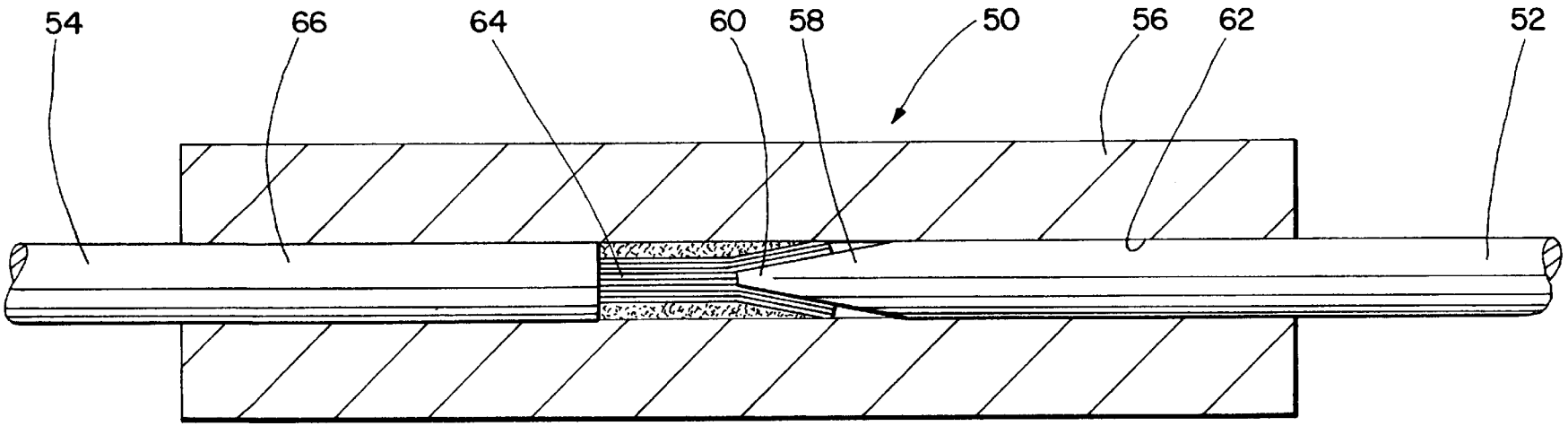
FIG. 2 is a partial cross-sectional view of the electrode assembly of the present invention.

A partial cross-sectional view of the electrode assembly 50 of the present invention is illustrated in FIG. 2. The electrode assembly 50 is comprised of an electrode 52, an insulated wire 54 and a ceramic tube 56. The electrode 52 is generally circular in cross-section and its end 58 is provided with a conically shaped tip 60. Tube 56 has a bore 62 which passes throughout its entire length. As such, it should be noted that electrode assembly 50 utilizes one less component than the electrode assembly 10 of the prior art since it does not require a ferrule. Also, in contrast to the electrode assembly 10 of the prior art, tube 56 does not have a counterbore. In summary, electrode assembly 50 of the present invention requires one less component than electrode assembly 10 of the prior art and the components that are utilized are less expensive to produce.

In order to assemble electrode assembly 50, the insulation is removed from the end of insulated wire 54 exposing wires 64. Epoxy is then dispensed into the bore 62 in tube 56. The insulated wire 54 is then received within the bore 62 in tube 56 through one end of tube 56 and is slidably advanced therein to the point where the wires 64 are in the approximate middle of tube 56. The end 58 of electrode 52 is then received within bore 62 in tube 56 through the opposite end of tube 56 and is slidably advanced therein so that conically shaped tip 60 contacts the ends of wires 64 causing the ends of wires 64 to flare outwardly and grippingly engage the surface defining the bore 62 in tube 56. The electrode assembly 50 is then placed in an oven for curing at approximately 300° F. for thirty minutes causing the epoxy within the bore 62 of the tube 56 to bond the tube 56 to the electrode 52, the wires 64 and the insulated portion 66 of insulated wire 54 resulting in a solid, unitary construction for the electrode assembly 50. Since the resulting electrode assembly 50 has a unitary construction, electrode 52 cannot move laterally or bend within tube 56 resulting in the elimination of stress cracks within tube 56. In addition, since the electrode assembly 50 does not utilize a counterbore, as in the prior art, the placement of a mounting bracket at any location along the length of tube 56 will not cause the creation of stress cracks within tube 56, as in the prior art. Furthermore, it has been found that the flaring of the ends of wires 64 by the conically shaped tip 60 on the end 58 of electrode 52 and the utilization of epoxy to bond same to the surface defining the bore 62 in tube 56 results in a firm mechanical connection between the wires 64 and the electrode 52 and a better electrical connection therebetween, when compared to the prior art. Lastly, it has been found that the mechanical strength of the electrode assembly 50 of the present invention is significantly greater than that of the electrode assembly 10 of the prior art, and the overall structure of the electrode assembly 50 results in a significant reduction in the number of electrode assembly "rejects" during production, when compared to prior art assemblies.

Certain modifications and improvements will occur to those skilled in the art upon reading the foregoing. It should be understood that all such modifications and improvements have been deleted herein for the sake of conciseness and readability, but are properly within the scope of the following claims.

I claim:

1. An electrode assembly for igniting a gas-fired burner comprising:

a tube member having a first end, an oppositely disposed second end and having a bore therethrough, said bore being of substantially constant diameter throughout said tube member;

an insulated electrical conductor received within said bore in said tube member through said first end of said tube member and being slidingly advanced within said bore in said tube member, said insulated electrical conductor having a plurality of substantially exposed electrical wires protruding from the end thereof; and an electrode member received within said bore in said tube member through said second end of said tube member and being slidably advanced within said bore in said tube member causing said electrode member to engage said electrical wires protruding from the end of said insulated electrical conductor resulting in said electrical wires contacting and grippingly engaging the surface defining said bore in said tube member.

2. The apparatus as defined in claim 1 wherein the end of said electrode member is conically shaped.

3. The apparatus as defined in claim 2 wherein said conically shaped end of said electrode member contacts said electrical wires protruding from the end of said insulated electrical conductor.

4. The apparatus as defined in claim 3 wherein engagement of said electrode member with said wires protruding from the end of said insulated electrical conductor to flare outwardly resulting in said wires being interposed between said conically shaped end of said electrode member and said bore in said tube member and causing said wires to grippingly engage said surface defining said bore in said tube member.

5. The apparatus as defined in claim 1 further including an adhesive material within said bore in said tube member.

6. The apparatus as defined in claim 5 wherein said adhesive material is located on the surface defining said bore in said tube member.

7. The apparatus as defined in claim 5 wherein said adhesive material within said bore in said tube member grippingly engages said insulated electrical conductor and said wires protruding from the end thereof.

8. The apparatus as defined in claim 1 wherein said tube member is formed from ceramic material.

* * * * *